US010485333B1

(12) United States Patent
Tan

(10) Patent No.: US 10,485,333 B1
(45) Date of Patent: Nov. 26, 2019

(54) ARTICULATED SUPPORT BRACKET

(71) Applicant: Zhuhai Shichang Metals Ltd., Zhuhai (CN)

(72) Inventor: Guogong Tan, Zhuhai (CN)

(73) Assignee: Zhuhai Shichang Metals Ltd., Zhuhai (CN)

( * ) Notice: Subject to any disclaimer, the term of this patent is extended or adjusted under 35 U.S.C. 154(b) by 0 days.

(21) Appl. No.: 16/044,570

(22) Filed: Jul. 25, 2018

(51) Int. Cl.
*A47B 3/091* (2006.01)
*A47B 3/08* (2006.01)

(52) U.S. Cl.
CPC ..... *A47B 3/0912* (2013.01); *A47B 3/0818* (2013.01); *A47B 2003/0827* (2013.01)

(58) Field of Classification Search
CPC .... A47B 2003/0824; A47B 3/08; A47B 3/091
USPC ..... 108/129, 131, 132; 248/188.6, 439, 166
See application file for complete search history.

(56) References Cited

U.S. PATENT DOCUMENTS 3,245,364 A * 4/1966 Weinberg ..... A47B 3/0818 108/125
4,341,164 A * 7/1982 Johnson ..... A47B 3/10 108/115
5,941,181 A * 8/1999 Hornberger ..... A47B 3/0911 108/131
5,983,807 A * 11/1999 Tarnay ..... A47B 3/0912 108/131
6,772,700 B2 * 8/2004 Wong ..... A47B 3/087 108/132
6,920,833 B2 * 7/2005 Lou-Hao ..... A47B 3/091 108/132
8,397,653 B2 * 3/2013 Ashby ..... A47B 3/0818 108/115
8,550,012 B2 * 10/2013 Rogers ..... A47B 3/0916 108/131
2002/0092446 A1 * 7/2002 Stanford ..... A47B 3/091 108/132
2005/0103239 A1 * 5/2005 Neunzert ..... A47B 3/087 108/132
2007/0012228 A1 * 1/2007 Tsai ..... A47B 3/091 108/126
2009/0199746 A1 * 8/2009 Horton ..... A47B 3/00 108/129
2009/0293778 A1 * 12/2009 Branch ..... A47B 3/0918 108/131
2010/0000448 A1 * 1/2010 Lin ..... A47B 13/003 108/132

* cited by examiner

*Primary Examiner* — Jose V Chen
(74) *Attorney, Agent, or Firm* — Luedeka Neely Group, P.C.

(57) ABSTRACT

An articulated support bracket for a table and a table containing the support bracket. The support bracket includes a first arm having a proximal end and a distal end, the proximal end being rotationally attached to a frame of a table or bench; a second arm having a proximal end and a distal end, the proximal end being rotationally attached to a leg of the table and the distal end being rotationally attached to the distal end of the first arm; and a locking ring slidably disposed on the first arm between the proximal end and the distal end of the first arm for engaging a locking portion of the second arm when the locking ring is in a locking position. The locking portion has a first edge that increasingly diverges from a second edge when moving from the distal end toward the proximal end of the second arm.

17 Claims, 5 Drawing Sheets

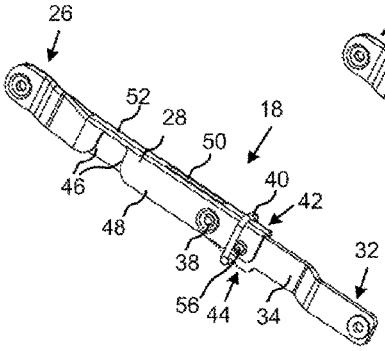
FIG. 3A
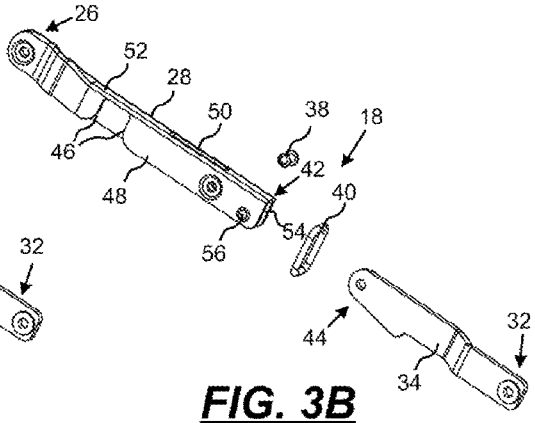
FIG. 3B
FIG. 3C
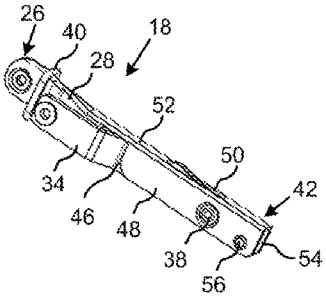
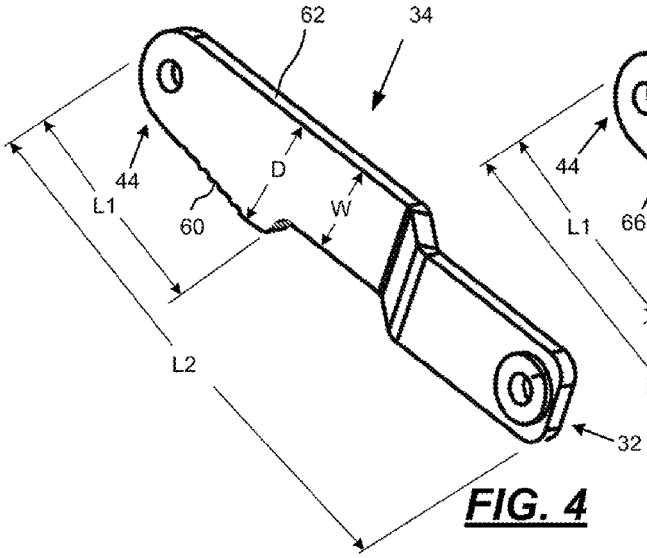
FIG. 4
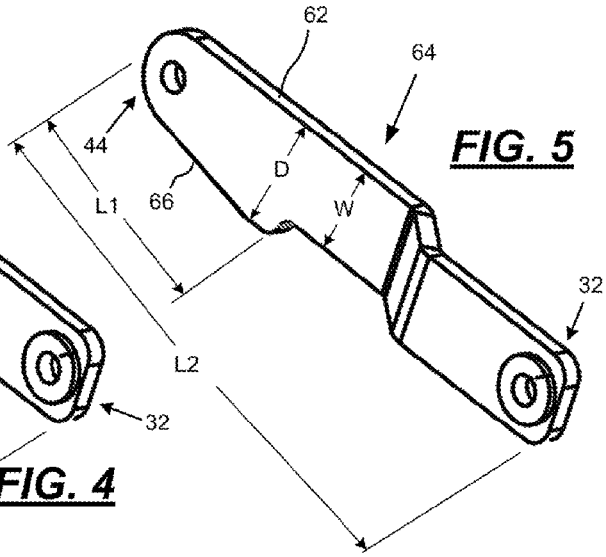
FIG. 5

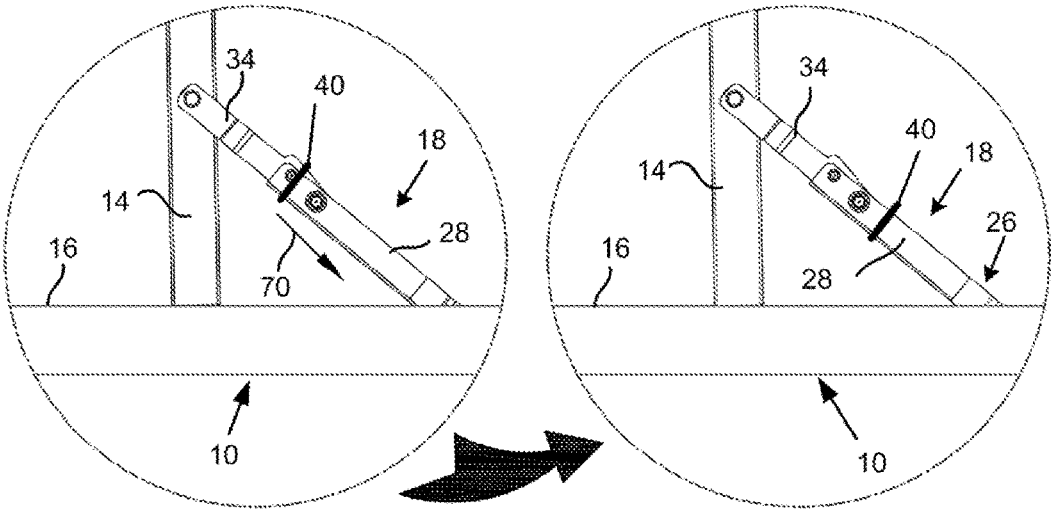
FIG. 7A
FIG. 7B
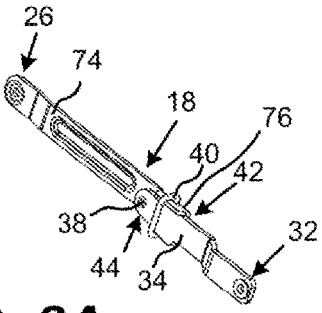
FIG. 8A
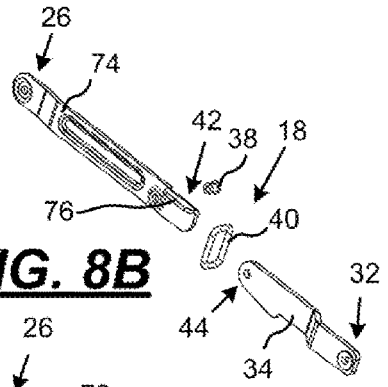
FIG. 8B
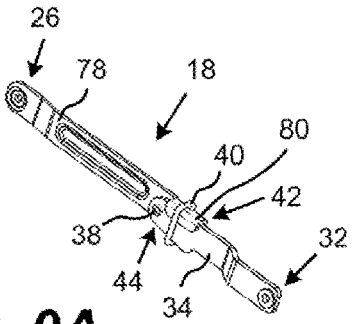
FIG. 9A
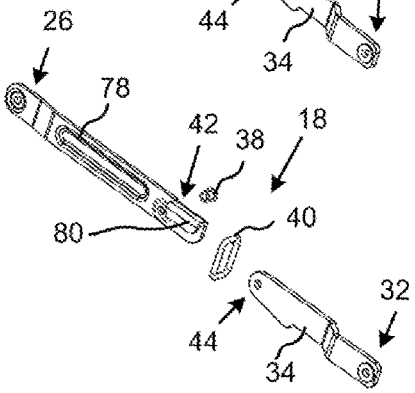
FIG. 9B

ARTICULATED SUPPORT BRACKET

TECHNICAL FIELD

This invention relates to the field of furniture. More particularly, this invention relates to an articulated support bracket and locking mechanism for a support structure having collapsible legs.

BACKGROUND

Banquet and utility tables having collapsible legs are well known. Likewise, benches having collapsible legs are known. Conventional collapsible tables and benches typically have a use configuration and a storage configuration. In the use configuration, a pair of collapsible legs is folded downwards from the tabletop or bench and are placed onto a ground surface to support the tabletop or bench in a raised position. In the storage configuration, the collapsible legs are folded underneath the tabletop or bench.

In order to prevent the table or bench from collapsing, a support bracket disposed between the table top or bench top and the collapsible legs is provided. The support bracket may include a locking mechanism to prevent the legs from collapsing during use of the table or bench. If the support bracket is not fully extended to the use position, the locking mechanism for the bracket may fail to be in a proper position for preventing the table or bench from collapsing.

What is needed, therefore, is a positive locking mechanism and articulated support bracket that automatically locks the bracket in the extended position when the legs are fully extended and the table or bench is in a use position and automatically unlocks the bracket when the table or bench is in an upside down leg folding position.

SUMMARY

The above and other needs are met by an articulated support bracket for a support structure, such as a table or bench, and a support structure containing the articulated support bracket. The support bracket includes a first arm having a first proximal end and a first distal end, the first proximal end being rotationally attached to a frame of the support structure; a second arm having a second proximal end and a second distal end, the second proximal end being rotationally attached to a leg of the support structure and the second distal end being rotationally attached to the first distal end of the first arm; and a locking ring slidably disposed on the first arm between the first proximal end and the first distal end of the first arm for engaging a locking portion of the second distal end of the second arm when the locking ring is in a locking position. The first arm also includes a stop adjacent to the first distal end to prevent over rotation of the second arm past a linear alignment with the first arm when the bracket is in an extended position. The locking portion of the second distal end of the second arm has a first edge that increasingly diverges from a second edge when moving from the second distal end to the second proximal end of the second arm.

In some embodiments, the first edge of the locking portion of the second arm has a notched edge. In other embodiments, the first edge of the locking portion of the second arm has a smooth edge.

In some embodiments, the stop adjacent the first distal end of the first arm is incorporated into a U-shaped channel extending from adjacent to the first distal end toward the first proximal end of the first arm. In other embodiments, the U-shaped channel also includes a slot on an edge portion of the U-shaped channel adjacent to the first distal end of the first arm for engaging a portion of the locking portion of the second arm when the first arm and second arm are in a folded position. In still other embodiments, the U-shaped channel includes a cutout on a side portion of the U-shaped channel adjacent to the first proximal end of the first arm for engaging the second arm when the first arm and second arm are in a folded position.

In some embodiments, the stop adjacent the first distal end of the first arm is incorporated into a U-shaped member disposed adjacent to the first distal end of the first arm. In other embodiments, the stop adjacent the first distal end of the first arm is incorporated into an L-shaped member.

In still other embodiments, there is provided a table having self-locking and self-unlocking collapsible legs. The table includes a tabletop, a frame attached to a bottom surface of the tabletop, and an articulated bracket attached to the frame and to each leg of the table. The articulated bracket includes a first arm having a first proximal end and a first distal end, the first proximal end being rotationally attached to a frame of a table; a second arm having a second proximal end and a second distal end, the second proximal end being rotationally attached to a leg of the table and the second distal end being rotationally attached to the first distal end of the first arm; and a locking ring slidably disposed on the first arm between the first proximal end and the first distal end of the first arm for engaging a locking portion of the second distal end of the second arm when the locking ring is in a locking position. The first arm includes a stop adjacent to the first distal end to prevent over rotation of the second arm past a linear alignment with the first arm when the bracket is in an extended position. The locking portion of the second distal end of the second arm has a first edge that increasingly diverges from a second edge when moving from the second distal end to the second proximal end of the second arm. The articulated bracket is self-locking when the table is in a use position and is self-unlocking when the table is in an upside down position.

An advantage of the articulated bracket and table or bench containing the bracket is that when the table or bench is in a use position, with the legs extended away from the bottom surface of the table or bench, the force of the legs on the ground will cause the bracket to be fully extended and the locking ring will automatically slide down the first arm to a locking engagement with the locking portion of the second arm. Likewise, when the table or bench is turned upside down so that the tabletop or benchtop is lying on the ground, the locking ring will automatically slide down the first arm from the locking position so that the bracket can be easily pushed in order to fold the legs against the bottom surface of the table or bench. A key feature enabling the self-locking and self-unlocking of the articulated bracket is the locking portion of the second arm that has the first edge that increasingly diverges from the second edge when moving from one end to the other of the second arm.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein:

FIG. 3A illustrates a perspective view, not to scale, of an articulated bracket in a fully extended and locked position according to an embodiment of the disclosure.

FIG. 3B illustrates a perspective exploded view, not to scale, of the articulated bracket of FIG. 3A.

FIG. 3C illustrates a perspective view, not to scale, of the articulated bracket of FIG. 3A in a folded position.

FIG. 4 illustrates a perspective view, not to scale, of a second arm of an articulated bracket according to embodiments of the disclosure.

FIG. 5 illustrates a perspective view, not to scale, of a second arm of an articulated bracket according to other embodiments of the disclosure.

FIGS. 7A-7B illustrate movement of a locking ring for the articulated bracket according to the disclosure when the table of FIG. 1A is in an upside down position with the tabletop on the ground.

FIG. 8A is a perspective view, not to scale, of an articulated bracket according to a second embodiment of the disclosure.

FIG. 8B is a perspective exploded view, not to scale, of the articulated bracket of FIG. 8A.

FIG. 9A is a perspective view, not to scale, of an articulated bracket according to a third embodiment of the disclosure.

FIG. 9B is a perspective exploded view, not to scale, of the articulated bracket of FIG. 9A.

DETAILED DESCRIPTION

As the term is used herein, a "support structure" is a rigid structure having a generally planar and horizontal top surface that may be used to support items or persons. Nonlimiting examples of support structures include tabletops and bench tops.

Figure 1A:
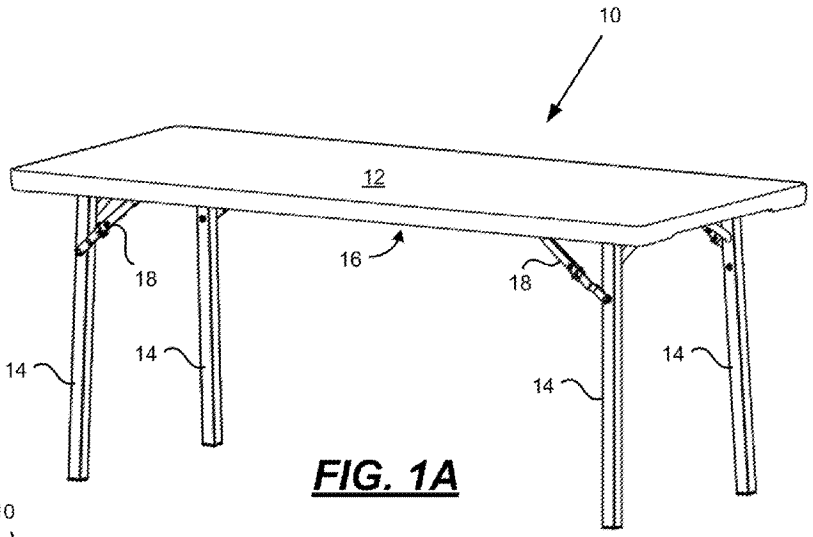
FIG. 1A illustrates a top perspective view, not to scale, of a collapsible table in a use position according to an embodiment of the disclosure.
Figure 1B:
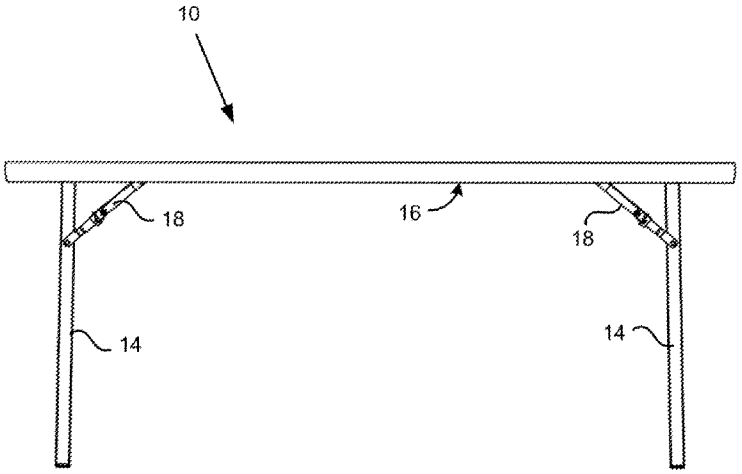
FIG. 1B illustrates a side view, not to scale, of the collapsible table of FIG. 1A.
Figure 1C:
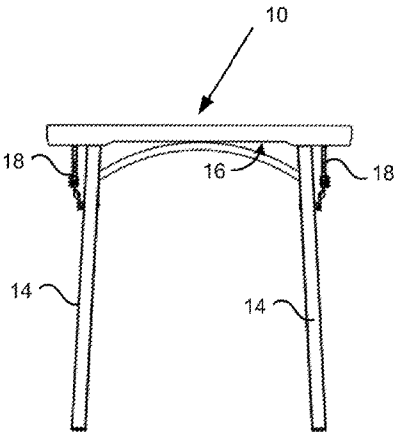
FIG. 1C illustrates an end view, not to scale, of the collapsible table of FIG. 1A.
Figure 2:
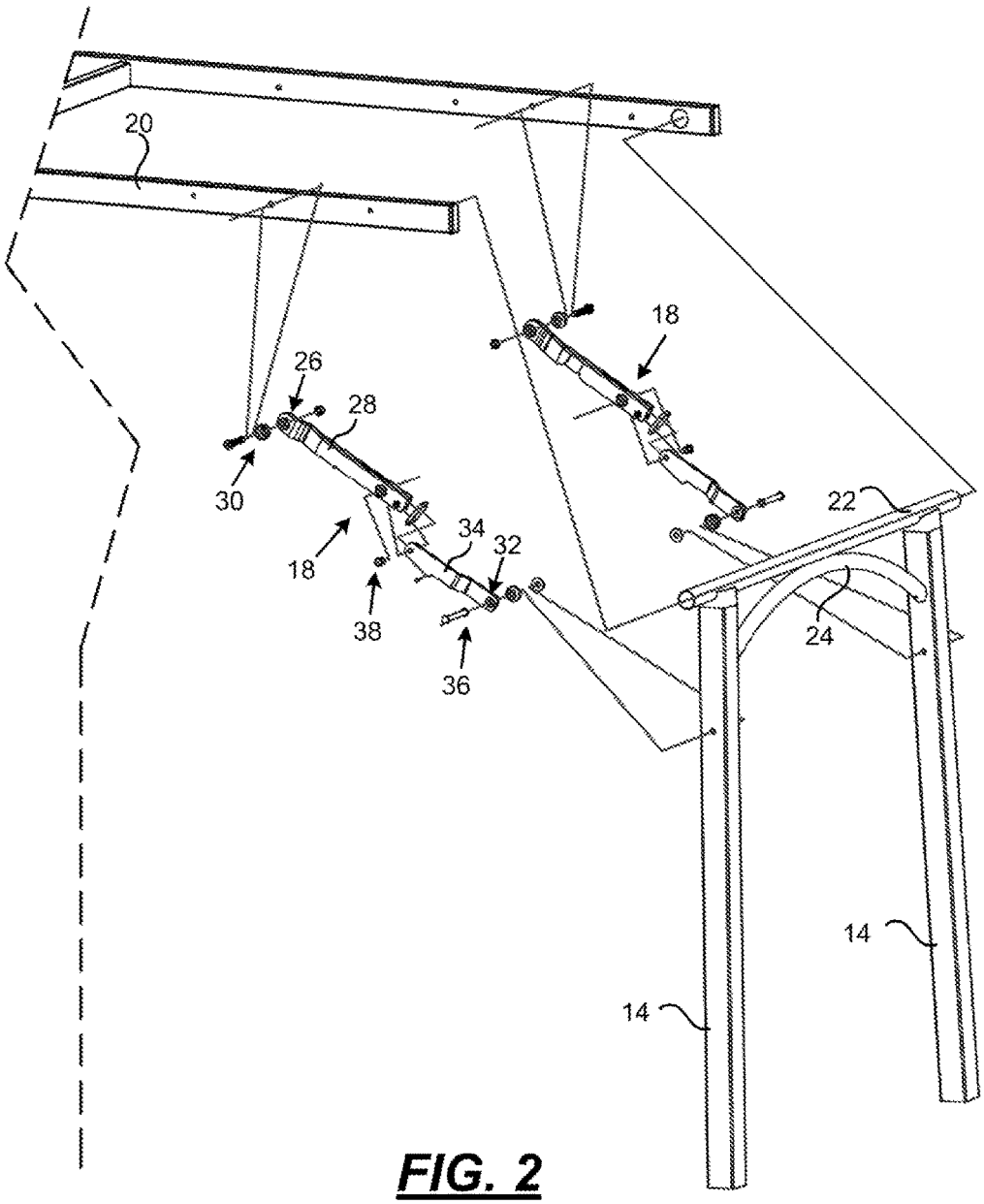
FIG. 2 illustrates a perspective exploded view, not to scale, of a frame, articulated brackets and legs for the collapsible table of FIG. 1A.
Figure 6A:
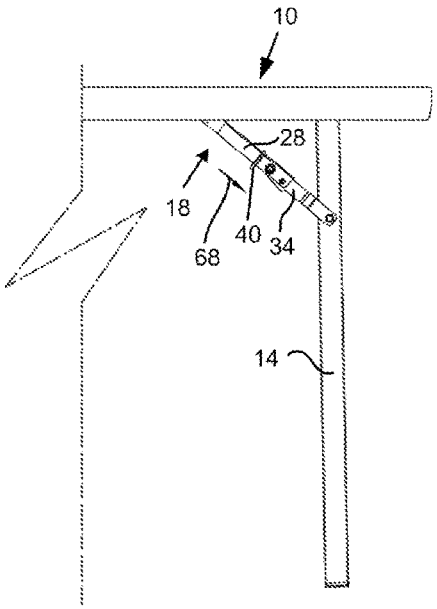
FIGS. 6A-6D illustrate movement of a locking ring for the articulated bracket according to the disclosure when the table of FIG. 1A is in a use position.
Figure 6B:
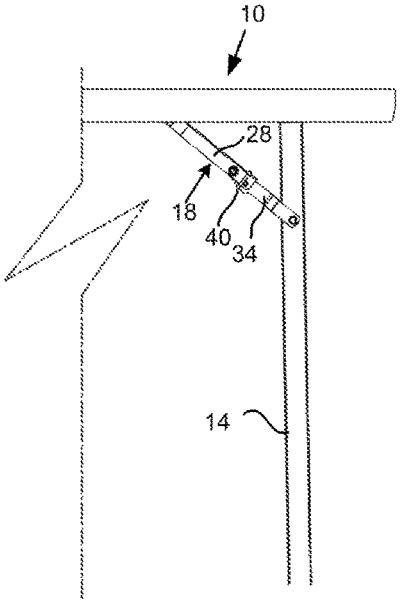
Figure 6C:
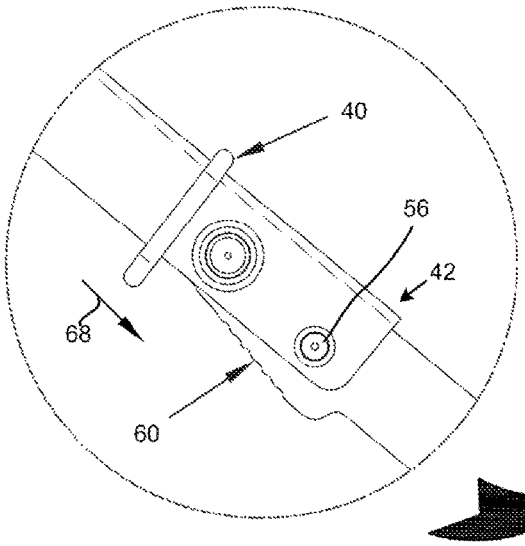
Figure 6D:
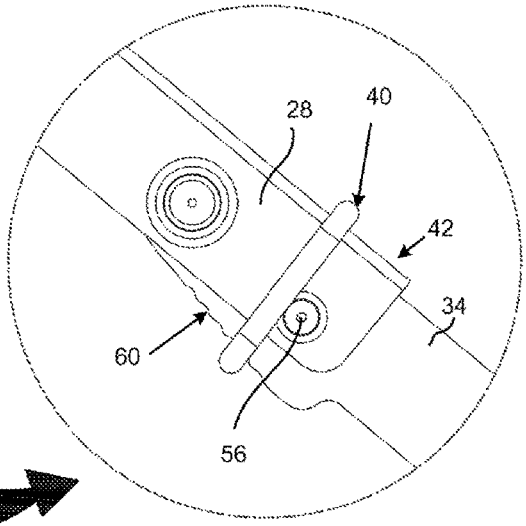

With reference now to FIGS. 1 and 2, there is shown a support structure in the form of a collapsible table 10 having a tabletop 12, legs 14 attached to a bottom surface 16 of the table 10, and articulated brackets 18 attached to the legs 14 and to a support frame 20. Each leg 14 may be independently rotatable with respect to the table or, as shown in FIG. 2, the legs 14 may be joined together by a rotatable cross-bar 22 and an arched frame member 24. The rotatable cross-bar 22 is rotatably attached to the frame 20 so that the legs 14 may be rotated from a use position to a collapsed position wherein the legs 14 are adjacent to the bottom surface 16 of the table 10.

The articulated brackets 18 are rotationally attached on a proximal end 26 of the first arm 28 to the frame 20 using fasteners 30. The brackets 18 are rotationally attached on a proximal end 32 of the second arm 34 to the legs 14 by fasteners 36. Likewise, the first arm 28 and second arm 34 are rotationally attached to one another by fasteners 38.

Further details of the articulated brackets 18 according to a first embodiment of the disclosure are illustrated in FIGS. 3A-3C, 4 and 5. In FIG. 3A, the articulated bracket 18 is shown in a fully extended position with the locking ring 40 adjacent to the distal end 42 of the first arm 28 and adjacent to the distal end 44 of the second arm 34. The first arm 28 also contains a cutout 46 on a side portion 48 thereof and a slot 50 on an edge portion 52 thereof. The purposes of the cutout 46 and slot 50 will be evident from FIG. 3C. In an optional embodiment, a locking ring stop 56 may be provided on the first arm 28 to prevent the locking ring 40 from moving past the distal end 42 of the first arm 28.

As seen more clearly in FIG. 3B, the first arm 28 is formed by a U-shaped channel 54 into which the second arm 34 is attached and can rotationally move so that the second arm 34 is substantially collinear with the first arm 28 in a folded position as shown in FIG. 3C. In the extended position, as shown in FIG. 3A, the U-shaped channel 54 also provides a stop on edge portion 52 to prevent the second arm 34 from over-rotating past an extended colinear position shown in FIG. 3A. In the folded colinear position shown in FIG. 3C, a portion of the second arm 34 extends through the slot 50 and the second arm 34 is folded into the cutout 46 of the first arm 28.

An important feature of the self-locking and self-unlocking ability of the articulated bracket 18 is the shape of the second arm 34 as shown in FIGS. 4 and 5. In FIG. 4, second arm 34 has grooved edge 60 adjacent to the distal end 44 thereof. The grooved edge 60 increasingly diverges from a second edge 62 The locking portion of the second distal end of the second arm has a first edge that increasingly diverges from a second edge when moving from the distal end 44 toward the proximal end 32 of the second arm 34. The length (L1) of the grooved edge 60 may range from about 0.1 to about 1.0 times the length (L2) of the arm 34, such as from about 0.2 to about 0.8 times L2 or from about 0.4 to about 0.6 times L2. However, the length L1 is not particularly critical and may be sufficiently long to allow free movement of the locking ring 40 over the divergent edge 60 so as to lock the articulated bracket in the extended colinear position shown in FIG. 3A. Likewise, the amount of divergence (D) relative to a nominal width (W) of the arm 34 may be no more than 2.0 times the width (W) and may range from about 1.1 to about 1.9 times the width (W) so that D/L1 ranges from about 0.1 to about 1.5. With reference to FIG. 5, arm 64 is similar to arm 34 with the exception that edge 66 is smooth rather than grooved as shown in FIG. 4.

FIGS. 6A-6D illustrate the movement of the locking ring 40 on the articulated bracket 18 when a table 10 is placed in an upright position with the legs 14 on the ground. As shown when moving from FIG. 6A to FIG. 6B as enlarged in FIGS. 6C and 6D, the locking ring 40 moves in the direction of arrow 68 so that the locking ring 40 automatically moves over the grooved edge 60 of the second arm 34 to prevent movement of the second arm 34 relative to the first arm 28 when the articulated bracket 18 is in the fully extended position. The depth of the grooves 60 are sufficient to enable ready movement of the ring 40 toward the distal end 42 of the first arm 28. When the table is turned upside down, as shown in FIG. 7A, gravity causes the locking ring 40 to automatically move in the direction of arrow 70 toward the proximal end 26 of the first arm 28 as shown in FIG. 7B. In the position shown in FIG. 7B, the articulated bracket 18 may be folded so that the legs 14 are folded against the bottom surface 16 of the table 10.

In order to simplify construction of the articulated bracket 18 according to the disclosure, a first arm 74 may be modified as shown in FIGS. 8A-8B. In this embodiment, instead of the U-shaped channel 54 of FIGS. 3A-3C, the distal end 42 of the first arm 74 has an L-shaped member 76 that prevents the second arm 34 from rotating past a linear alignment with the first arm 74 when the bracket 18 is in the fully extended position. The locking ring 40 will operate in a similar fashion on the first arm 74 as it did on the first arm 28 to automatically lock and unlock the articulated bracket 18. The first arm 74 does not require the cutout 46 or slot 50 required by the first arm 28 of FIGS. 3A-3C thus simplifying the construction of the first arm 74 of the articulated bracket 18. When the legs are folded, against the bottom surface 16 of the table, the second arm 34 is folded in a colinear position with the first arm 74.

In yet another embodiment shown in FIGS. 9A and 9B, a first arm is 78 includes a U-shaped member 80 that is adjacent to the distal end 42 of the first arm 78. The U-shaped member 80 like the L-shaped member 76 prevents the second arm 34 from rotating past a colinear position relative to the first arm 78 when the bracket 18 is in the fully extended position. As with first arm 74, the U-shaped member enables simpler construction of the first arm 78 thereby eliminating the need for the cutout 46 and slot 50 required by the first arm 28. In all other respects, the articulated bracket 18 of FIGS. 9A and 9B operates similarly to the articulated brackets 18 disclosed herein.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An articulated support bracket for a support structure, the support bracket comprising:

a first arm having a first proximal end and a first distal end, the first proximal end being rotationally attached to a frame of the support structure;

a second arm having a second proximal end that is rotationally attached to a leg of the support structure, a second distal end that is rotationally attached to the first distal end of the first arm, and a locking portion disposed at the second distal end of the second arm, the locking portion having a first edge that increasingly diverges from a second edge in a direction from the second distal end toward the second proximal end of the second arm; and a locking ring slidably disposed on the first arm between the first proximal end and the first distal end of the first arm, wherein the locking ring engages the first edge of the locking portion of the second arm when the locking ring is in a locking position, wherein the first arm further comprises a stop adjacent to the first distal end that impedes rotation of the second arm beyond linear alignment with the first arm when the bracket is in an extended position.

2. The articulated support bracket of claim 1, wherein the first edge of the locking portion of the second arm has a notched edge.

3. The articulated support bracket of claim 1, wherein the first edge of the locking portion of the second arm has a smooth edge.

4. The articulated support bracket of claim 1, wherein the stop adjacent the first distal end of the first arm is incorporated into a U-shaped channel extending from adjacent to the first distal end toward the first proximal end of the first arm.

5. The articulated support bracket of claim 4, wherein the U-shaped channel further comprises a slot on an edge portion of the U-shaped channel adjacent to the first distal end of the first arm for engaging a portion of the locking portion of the second arm when the first arm and second arm are in a folded position.

6. The articulated support bracket of claim 4, wherein the U-shaped channel further comprises a cutout on a side portion of the U-shaped channel adjacent to the first proximal end of the first arm for engaging the second arm when the first arm and second arm are in a folded position.

7. The articulated support bracket of claim 1, wherein the stop adjacent the first distal end of the first arm is incorporated into a U-shaped member disposed adjacent to the first distal end of the first arm.

8. The articulated support bracket of claim 1, wherein the stop adjacent the first distal end of the first arm is incorporated into an L-shaped member adjacent to the first distal end of the first arm.

9. A support structure having four collapsible legs comprising the articulated bracket of claim 1 attached to each of the four collapsible legs and to frame of the support structure.

10. A table having self-locking and self-unlocking collapsible legs, the table comprising:

a tabletop, a frame attached to a bottom surface of the tabletop, and an articulated bracket attached to the frame and to each leg of the table, the articulated bracket comprising:

a first arm having a first proximal end and a first distal end, the first proximal end being rotationally attached to the frame;

a second arm having a second proximal end that is rotationally attached to a leg of the table, a second distal end that is rotationally attached to the first distal end of the first arm, and a locking portion disposed at the second distal end of the second arm, the locking portion having a first edge that increasingly diverges from a second edge in a direction from the second distal end toward the second proximal end of the second arm; and a locking ring slidably disposed on the first arm between the first proximal end and the first distal end of the first arm, wherein the locking ring engages the first edge of the locking portion of the second arm when the locking ring is in a locking position, wherein the first arm further comprises a stop adjacent to the first distal end that impedes rotation of the second arm beyond linear alignment with the first arm when the bracket is in an extended position, and wherein the bracket is self-locking when the table is in a use position and is self-unlocking when the table is in an upside down position.

11. The table of claim 10, wherein the first edge of the locking portion of the second arm has a notched edge.

12. The table of claim 10, wherein the first edge of the locking portion of the second arm has a smooth edge.

13. The table of claim 10, wherein the stop adjacent the first distal end of the first arm is incorporated into a U-shaped channel extending from adjacent to the first distal end toward the first proximal end of the first arm.

14. The table of claim 13, wherein the U-shaped channel further comprises a slot on an edge portion of the U-shaped channel adjacent to the first distal end of the first arm for engaging a portion of the locking portion of the second arm when the first arm and second arm are in a folded position.

15. The table of claim 13, wherein the U-shaped channel further comprises a cutout on a side portion of the U-shaped channel adjacent to the first proximal end of the first arm for engaging the second arm when the first arm and second arm are in a folded position.

16. The table of claim 10, wherein the stop adjacent the first distal end of the first arm is incorporated into a U-shaped member disposed adjacent to the first distal end of the first arm.

17. The table of claim 10, wherein the stop adjacent the first distal end of the first arm is incorporated into an L-shaped member adjacent to the first distal end of the first arm.

* * * * *